US007788934B2

(12) United States Patent
Kodama et al.

(10) Patent No.: US 7,788,934 B2
(45) Date of Patent: Sep. 7, 2010

(54) CONTROL DEVICE FOR AN AUGER TYPE ICE MAKING MACHINE

(75) Inventors: Akihiro Kodama, Aichi (JP); Tomohito Nomura, Aichi (JP); Yasuki Mizutani, Aichi (JP); Hiroyuki Sugie, Aichi (JP); Shigeaki Tamaki, Aichi (JP)

(73) Assignee: Hoshizaki Denki Kabushiki Kaisha, Toyoake-shi, Aichi (JP)

( * ) Notice: Subject to any disclaimer, the term of this patent is extended or adjusted under 35 U.S.C. 154(b) by 1476 days.

(21) Appl. No.: 10/540,481

(22) PCT Filed: Oct. 31, 2003

(86) PCT No.: PCT/JP03/14021

§ 371 (c)(1),
(2), (4) Date: Jun. 23, 2005

(65) Prior Publication Data

US 2009/0326716 A1 Dec. 31, 2009

(51) Int. Cl.
*F25C 1/00* (2006.01)

(52) U.S. Cl. ..... 62/135; 62/340

(58) Field of Classification Search ..... 62/66, 62/135, 150, 196.3, 340
See application file for complete search history.

(56) References Cited

U.S. PATENT DOCUMENTS 6,385,981 B1 * 5/2002 Vaisman ..... 62/196.3
6,463,746 B1 * 10/2002 Bethuy et al. ..... 62/66
6,609,387 B2 * 8/2003 Sasaki et al. ..... 62/125
6,915,647 B2 * 7/2005 Tsuchikawa et al. ..... 62/129
2007/0125116 A1 * 6/2007 Kuroyanagi et al. ..... 62/354

FOREIGN PATENT DOCUMENTS

| | | |
|---|---|---|
| JP | 61-243266 | 10/1986 |
| JP | 1-238419 | 9/1989 |
| JP | 2-213670 | 8/1990 |
| JP | 7-122109 | 5/1995 |
| JP | 2002-318043 | 10/2002 |

* cited by examiner

*Primary Examiner*—Marc E Norman
(74) *Attorney, Agent, or Firm*—Wenderoth, Lind & Ponack, L.L.P.

(57) ABSTRACT

A control device for an auger type ice making machine according to the present invention includes a driver circuit that drives a geared motor for rotating an auger; a voltage detector that detects an input voltage applied to the geared motor; a current detector that detects a motor current flowing in the geared motor; and a control circuit in which a plurality of current threshold values that differ according to the input voltage are set in advance, the control circuit controlling the driver circuit so as to stop the geared motor when a value of the motor current detected by the current detector exceeds a current threshold value that corresponds to the value of the input voltage detected by the voltage detector.

20 Claims, 14 Drawing Sheets

CONTROL DEVICE FOR AN AUGER TYPE ICE MAKING MACHINE

TECHNICAL FIELD

This invention relates to a control device for an auger type ice making machine.

BACKGROUND ART

An auger type ice making machine has a refrigeration casing that is a vertically elongated cylindrical member. A cooling pipe that constitutes an evaporator of a refrigeration circuit is wrapped around an outer circumferential surface of the refrigeration casing, and an auger having a helical blade is provided in an inner portion thereof. Ice making water is supplied to the inner portion of the refrigeration casing. Ice that grows on an inner circumferential surface of the refrigeration casing is scraped off by rotation of the helical blade, becoming flake ice, and is conveyed upward by helical action. A pressing head is disposed in an upper portion of the refrigeration casing in order to form the ice into a predetermined shape and predetermined hardness.

However, the refrigeration casing may become overcooled when, for some reason or another, there is an ice blockage in an internal portion of the pressing head, when there is an insufficient supply of ice making water, when an abnormality occurs in the refrigeration circuit, or the like. Ice making water in the inner portion of the refrigeration casing completely freezes if the ice making machine is driven in this state. Not only is there an excessive load applied to the auger, a geared motor that drives the auger, the refrigeration casing, an upper bearing, and a seal that partitions the geared motor and the ice making water, there is also a possibility that damage may occur to the auger, the geared motor, the refrigeration casing, the upper bearing, the seal, and the like.

There is conventionally a method in which an overload relay is used as a protecting device for protecting a geared motor against this problem by stopping the geared motor when the overload relay detects that a load applied to the geared motor has exceeded a predetermined value. As shown in FIG. 14*a*, this is a method in which the overlay relay operates when the geared motor is locked and a lock current higher than a motor current during normal operation flows for a fixed period of time.

If so-called hunting occurs, however, where forward rotation and reverse rotation of the auger are repeated, beginning with the forward rotating auger being unable to scrape off the ice for some reason or another, the auger then rotating in reverse due to the impact, and in addition, the auger again rotating forward due to a collision with the ice, the motor current will fluctuate as shown in FIG. 14*b*. The current value repeatedly moves back and forth between the lock current and a value in the vicinity of the electric current during normal operation. Consequently, the overload relay does not operate, and the geared motor cannot be protected.

A protecting device is proposed in JP 4-24625 B in which current flowing in a geared motor is converted to voltage, and operation of the geared motor is stopped when the converted voltage becomes larger than a predetermined value. According to this protecting device, operation of the geared motor is stopped when the current flowing in the geared motor increases and the converted voltage becomes larger than the predetermined value, even for an instant, during ice making operations. It therefore becomes possible to stop the geared motor even during hunting.

However, the motor current flowing in the geared motor also fluctuates due to the value of an input voltage that is applied to the geared motor. Accordingly, there is a fear that an overload state may be judged to have occurred whenever the motor current fluctuates, even during normal ice making operation, causing operation of the geared motor to be stopped.

DISCLOSURE OF THE INVENTION

This invention has been made to eliminate problems like those described above. Accordingly, an object of this invention is to provide a control device for an auger type ice making machine capable of controlling the rotation of a geared motor by correctly judging an overload state, even if the value of an input voltage fluctuates.

According to a first aspect of the present invention, there is provided a control device for an auger type ice making machine, including: a driver circuit that drives a geared motor for rotating an auger; a voltage detector that detects an input voltage applied to the geared motor; a current detector that detects a motor current flowing in the geared motor; and a control circuit in which a plurality of current threshold values that differ according to the input voltage are set in advance, the control circuit controlling the driver circuit so as to stop the geared motor when a value of the motor current detected by the current detector exceeds a current threshold value that corresponds to the value of the input voltage detected by the voltage detector.

According to a second aspect of the present invention, there is provided a control circuit of an auger type ice making machine, including: a driver circuit that drives a geared motor for rotating an auger; a voltage detector that detects an input voltage applied to the geared motor; a rotating speed detector that detects a rotating speed of the geared motor; and a control circuit in which a plurality of rotating speed threshold values that differ according to the input voltage are set in advance, the control circuit controlling the driver circuit so as to stop the geared motor when a value of the rotating speed detected by the rotating speed detector exceeds a rotating speed threshold value that corresponds to the value of the input voltage detected by the voltage detector.

Further, according to a third aspect of the present invention, there is provided a control device for an auger type ice making machine, including: a voltage detector that detects an input voltage applied to a geared motor for rotating an auger; a current detector that detects a motor current flowing in the geared motor; and a control circuit which determines a threshold value for the motor current according to a value of the input voltage detected by the voltage detector, and which, when a value of the motor current detected by the current detector exceeds the threshold value, controls operation of a refrigeration circuit of the ice making machine such that a refrigeration capacity of the refrigeration circuit decreases.

Further, according to a fourth aspect of the present invention, there is provided a control device for an auger type ice making machine, including: a voltage detector that detects an input voltage applied to a geared motor for rotating an auger; a rotating speed detector that detects a rotating speed of the geared motor; and a control circuit which determines a threshold value for the rotating speed of the geared motor according to a value of the input voltage detected by the voltage detector, and which, when a value of the rotating speed detected by the rotating speed detector is less than the threshold value, controls operation of a refrigeration circuit of the ice making machine such that a refrigeration capacity of the refrigeration circuit decreases.

DETAILED DESCRIPTION OF THE INVENTION

Embodiments of this invention are explained below based on the appended drawings.

Embodiment 1

Figure 1:
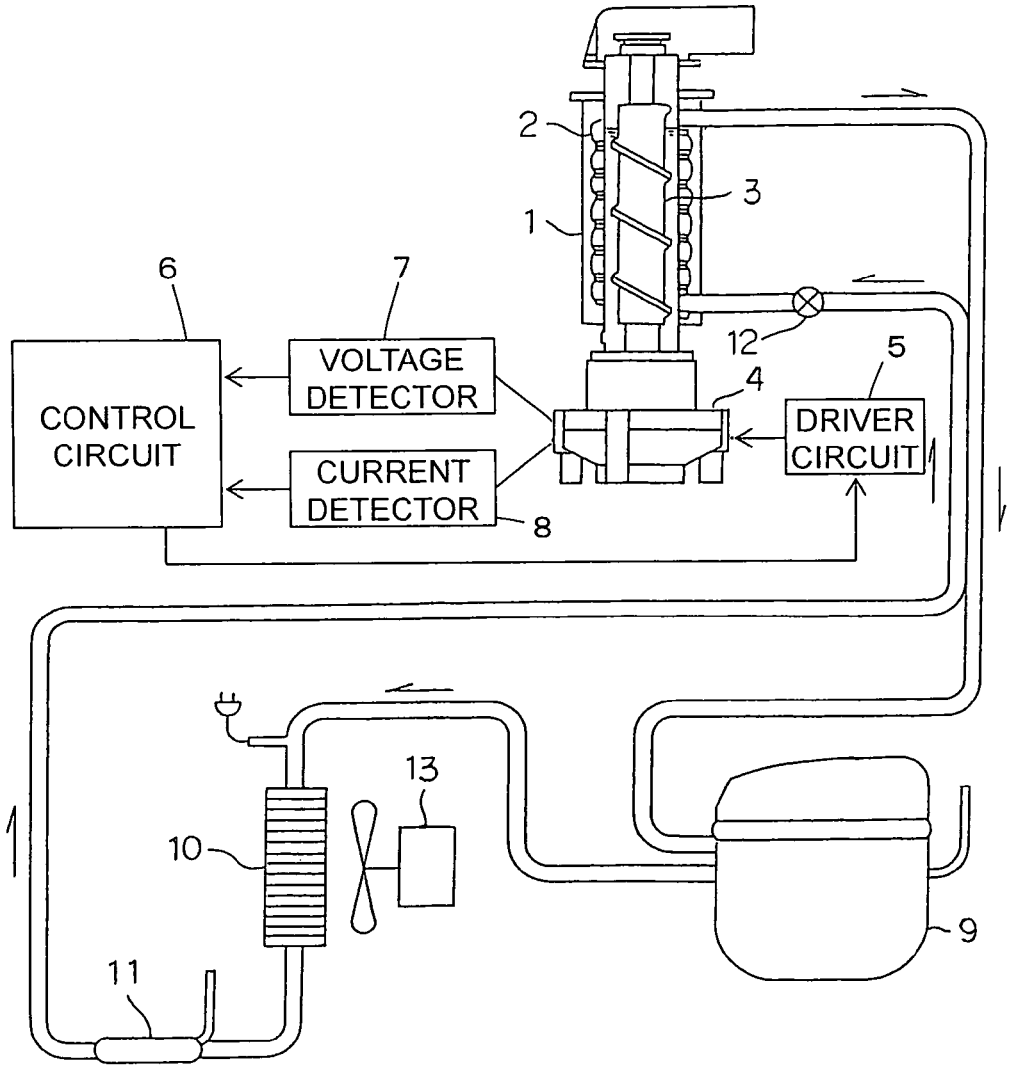
FIG. 1 is a block diagram that shows a configuration of an auger type ice making machine provided with a control device according to Embodiment 1 of this invention.

FIG. 1 shows a configuration of an auger type ice making machine provided with a control device according to Embodiment 1 of this invention. The auger type ice making machine has a refrigeration casing 1. An evaporation pipe 2 is wrapped around an outer circumferential surface of the refrigeration casing 1, and an auger 3 used for removing ice and having a helical blade is supported in an inner portion of the refrigeration casing 1. The auger 3 is rotated by a DC brushless geared motor 4, for example.

A driver circuit 5 is connected to the geared motor 4, and in addition, a control circuit 6 is connected to the driver circuit 5. Further, a voltage detector 7 and a current detector 8 are connected to the geared motor 4. The control circuit 6 is connected to the voltage detector 7 and the current detector 8.

The evaporation pipe 2 of the refrigeration casing 1 constitutes an evaporator and, together with a compressor 9, a condenser 10, a drier 11, and an expansion valve 12, forms a refrigeration circuit. It should be noted that a fan motor 13 is disposed in the vicinity of the condenser 10 in order to air cool the condenser 10.

Figure 2:
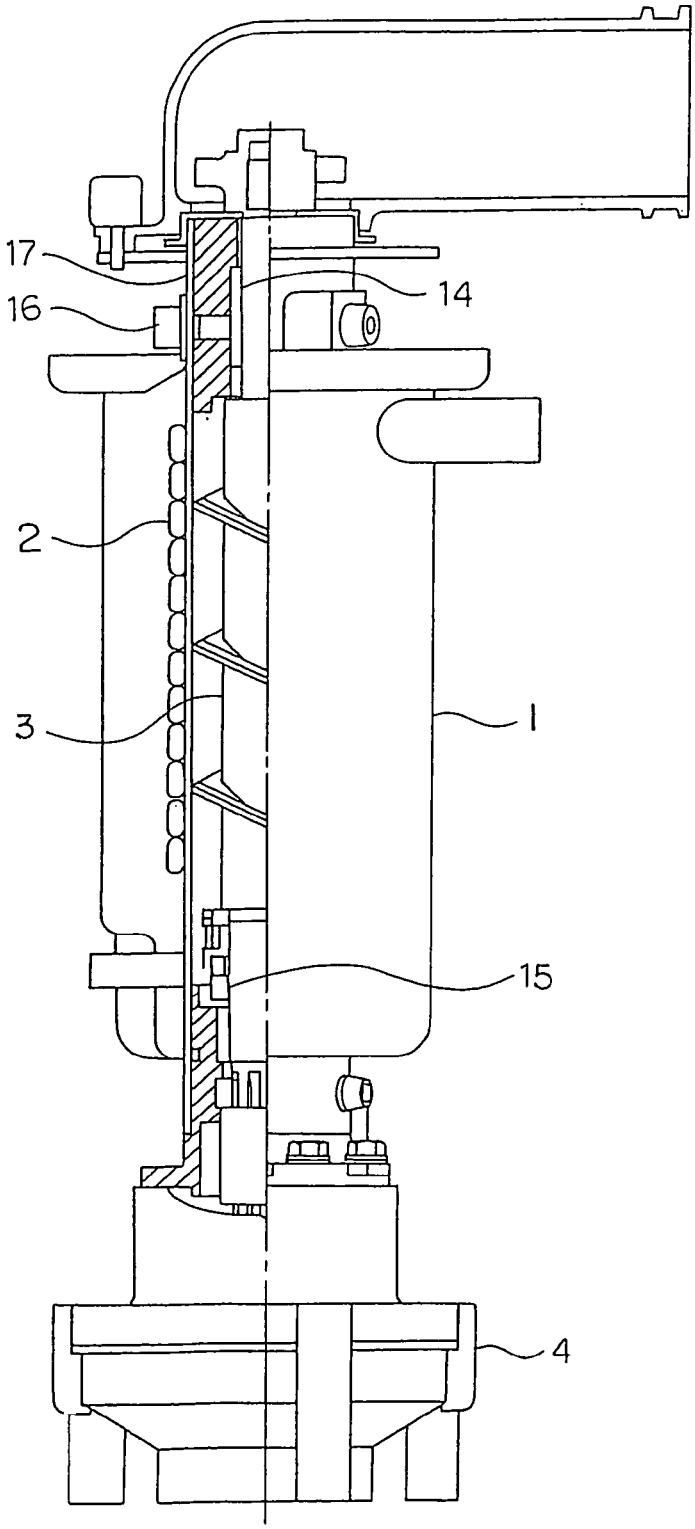
FIG. 2 is a partially cutaway side view that shows a configuration of an ice making portion of the auger type ice making machine.

As shown in FIG. 2, the auger 3 is supported in the inner portion of the refrigeration casing 1 by an upper bearing 14 and a lower bearing 15 so as to be free to rotate. The upper bearing 14 is fixed to an upper end portion of the refrigeration casing 1 by a fixing bolt 16. The geared motor 4 that is connected to a lower end of the refrigeration causing 1 rotates the auger 3. Ice that grows on an inner circumferential surface of the refrigeration casing 1 is scrapped off, and is transferred to a plurality of stationary blades 17 formed in an outer circumferential portion of the upper bearing 14.

Operation of the control device for the auger type ice making machine according to Embodiment 1 is explained next. First, when electric power to the auger type ice making machine is turned on, water is supplied to a float tank (not shown), after which the refrigeration circuit is driven, the geared motor 4 is driven by the driving circuit 5, and ice making operations begin.

Ice making water from the float tank is thus supplied within the refrigeration casing 1. The evaporation pipe 2 cools the ice making water, and ice grows on the inner circumferential surface of the refrigeration casing 1. The ice is scrapped off by rotation of the auger 3, becoming flake ice, and is conveyed upward by helical action. The flake ice is formed into a predetermined shape and hardness by the stationary blades 17.

An input voltage applied from the driver circuit 5 to the geared motor 4 accompanying the above ice making operations is detected by the voltage detector 7, while a motor current that flows in the geared motor 4 is detected by the current detector 8. The detected voltage and the detected current are sent to the control circuit 6. A plurality of current threshold values Ith that differ according to the input voltage to the geared motor 4 are set in advance in the control circuit 6. For example, there is the current threshold value Ith that is set to a value of 2.5 A corresponding to a low voltage input like that shown in FIG. 3*a*, and there is the current threshold value Ith that is set to a value of 4 A corresponding to a high voltage input like that shown in FIG. 3*b*. It should be noted that the values of the current threshold value Ith may be adjusted an appropriate.

Figure 3A:
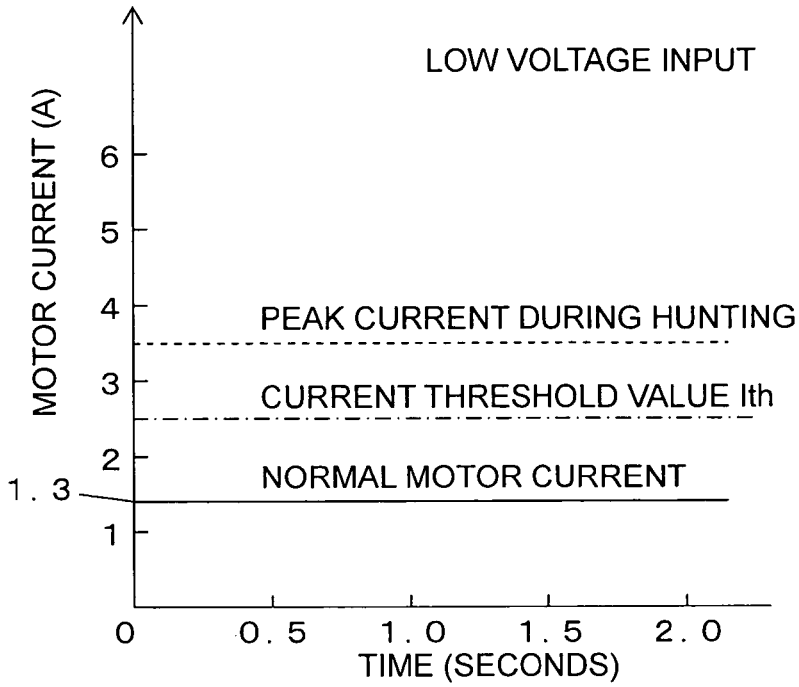
FIGS. 3*a* and 3*b* are timing charts that show motor current in Embodiment 1 during low voltage input and during high voltage input, respectively.

The normal motor current for a case where a low voltage is input from the driver circuit 5 to the geared motor 4 is on the order of 1.3 A as shown in FIG. 3*a*. The input voltage detected by the voltage detector 7 shows a low voltage at this point. Accordingly, the control circuit 6 selects the current threshold value Ith that is set to the value of 2.5 A, and compares the motor current detected by the current detector 8 with the current threshold value Ith=2.5 A. The control circuit 6 controls the driver circuit 5 to stop the geared motor 4 when the motor current exceeds the current threshold value Ith.

So-called hunting may occur here, where forward rotation and reverse rotation of the auger are repeated, beginning with the forward rotating auger being unable to scrape off the ice for some reason or another, the auger then rotating in reverse due to the impact, and in addition, the auger again rotating forward due to a collision with the ice. The peak current during hunting becomes approximately 3.5 A for cases in which a low voltage is input. The motor current therefore exceeds the current threshold value Ith at the point where hunting begins to occur. Consequently, the control circuit 6 controls the driver circuit 5 to stop rotation of the geared motor 4.

Figure 3B:
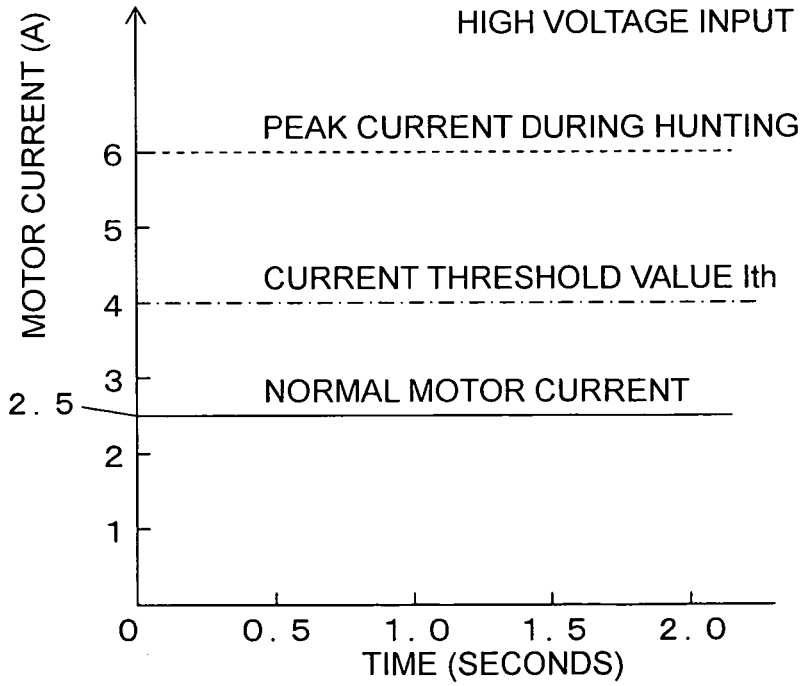

On the other hand, as FIG. 3*b* shows, the normal motor current is on the order of 2.5 A for cases where a high voltage is input from the driver circuit 5 to the geared motor 4. Since the input voltage detected by the voltage detector 7 shows high voltage, the control circuit 6 selects the current threshold value Ith set to a value of 4 A. That is, the motor current detected by the current detector 8 is compared to the current threshold value Ith=4 A. The driver circuit 5 is controlled to stop the geared motor 4 when the motor current exceeds the current threshold value Ith.

The peak current during hunting becomes approximately 6 A when a high voltage is input. The motor current therefore exceeds the current threshold value Ith at the point where hunting begins to occur for some reason or another. Consequently, the control circuit 6 controls the driver circuit 5 to stop rotation of the geared motor 4.

One of the two types of the current threshold values Ith set in advance is thus selected according to the input voltage to the geared motor 4, and a comparison with the motor current is performed. Accordingly, overload states such as hunting and locking can be accurately judged and operation of the geared motor can be stopped, even if the motor current fluctuates according to input voltage values.

It should be noted that the current threshold value Ith is not limited to two types of values corresponding to low voltage and high voltage. It is also possible to set three or more types of values for the current threshold value Ith, thus performing determination of the overload state in a multi-staged manner according to input voltage. Further, the current threshold value Ith can also be set in the form of a relational expression with respect to input voltage.

Furthermore, a current peak on the same order as that during hunting occurs during start-up of the geared motor 4. Accordingly, it is preferable that the control circuit 6 be configured so as to ignore the motor current value detected by the current detector 8 during start-up of the geared motor 4, and to cancel the first current peak occurring after the start-up.

Alternatively, it is preferable that the current threshold value Ith be set in advance in the control circuit 6 to a high value corresponding to start-up of the geared motor 4, and that the control circuit 6 be not actuated by the first current peak occurring after the start-up.

Erroneous operation during start-up can thus be prevented.

Embodiment 2

Figure 4:
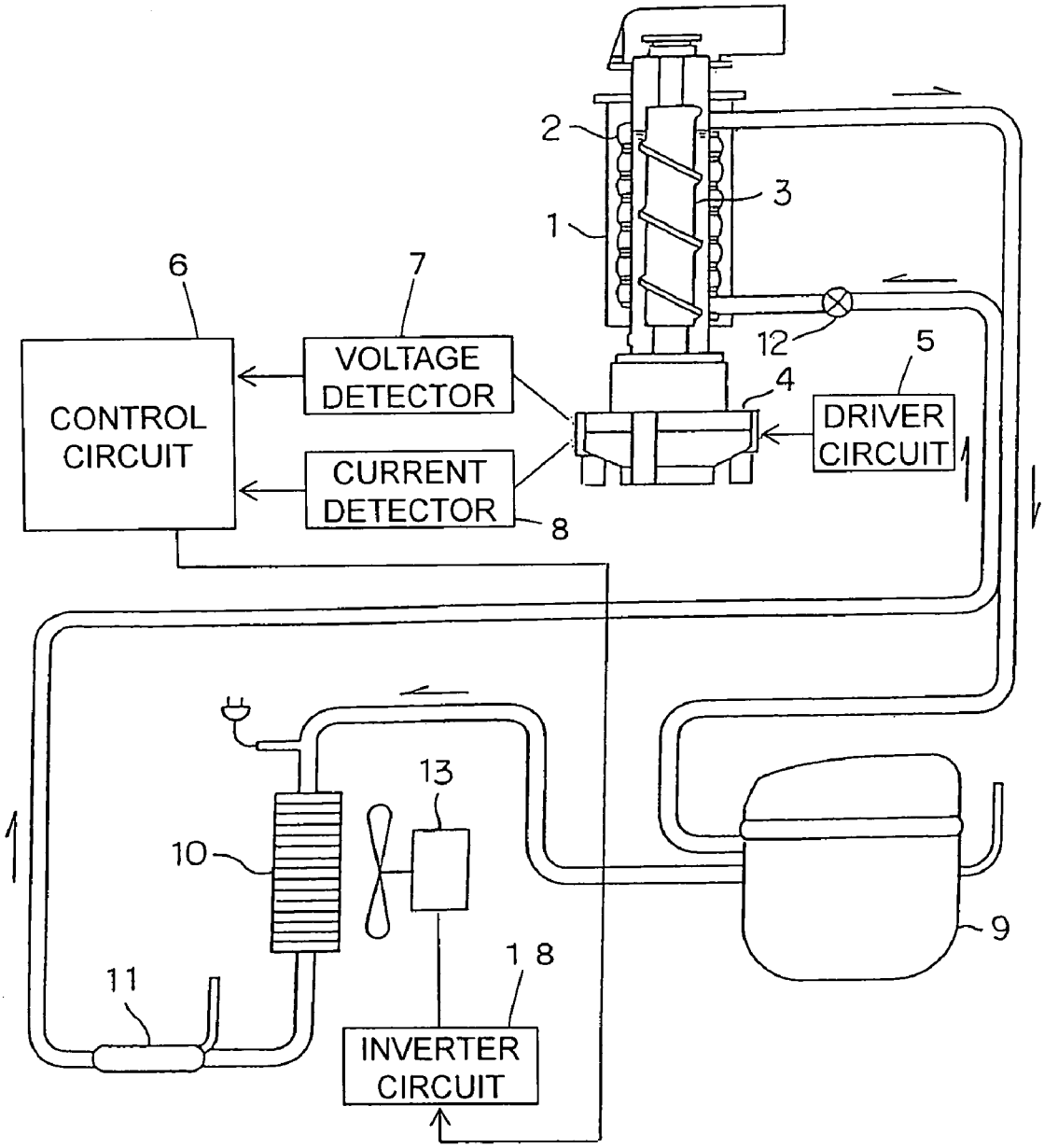
FIG. 4 is a block diagram that shows a configuration of an auger type ice making machine provided with a control device according to Embodiment 2.

FIG. 4 shows a configuration of an auger type ice making machine provided with a control device according to Embodiment 2. This auger type ice making machine is one in which the auger type ice making machine of Embodiment 1 shown in FIG. 1 has an inverter circuit 18 connected to the fan motor 13 of the condenser 10 and serving as a regulating circuit for driving the fan motor 13 at variable speed. The inverter circuit 18 is connected to the control circuit 6.

Operation of Embodiment 2 is explained with reference to a flowchart of FIG. 5. First, when electric power to the auger type ice making machine is turned on, water is supplied to a float tank (not shown), after which the refrigeration circuit is driven, the geared motor 4 is driven by the driving circuit 5, and ice making operations begin. When rotation of the geared motor 4 is verified by the control circuit 6 in step S1, in step S2, the control circuit 6 reads in a voltage value E of the input voltage of the geared motor 4 and a current value I of the motor current detected by the voltage detector 7 and the current detector 8, respectively, and then determines the motor current threshold value Ith based on the voltage value E in the subsequent step S3.

In addition, in step S4 the control circuit 6 compares the motor current I detected by the current detector 8 to the threshold value Ith determined in step S3. The control circuit 6 judges that the refrigeration casing 1 is overcooled when the motor current I exceeds the threshold value Ith, and controls the inverter circuit 18 so as to decrease the rotating speed of the fan motor 13 in step S5. Not only does the condensation capacity of the condenser 10 thus decrease, the refrigeration capacity of the refrigeration circuit also decreases, thus suppressing overcooling. At this point the geared motor 4 continues to rotate, and ice making operations continue. On the other hand, when it is judged in step S4 that the motor current I is equal to or less than the threshold value Ith, operation proceeds to step S6, and the inverter circuit 18 is controlled so that the fan motor 13 maintains the rotating speed of normal rotation.

Thereafter, when the geared motor is confirmed to be rotating in step S7, processing returns to step S2 and the voltage value E and the current value I are read in again. The processing of steps S2 to S7 is then repeated.

Overcooling is therefore gradually eliminated while repeating the processes of steps S2 to S7 for cases where the motor current I is judged to exceed the threshold value Ith in step S4, and the rotating speed of the fan motor 13 is decreased in step S5. The fan motor 13 is returned to the rotating speed of normal operation in step S6 at the point where the motor current I becomes equal to or less than the threshold value Ith.

Embodiment 3

Figure 6:
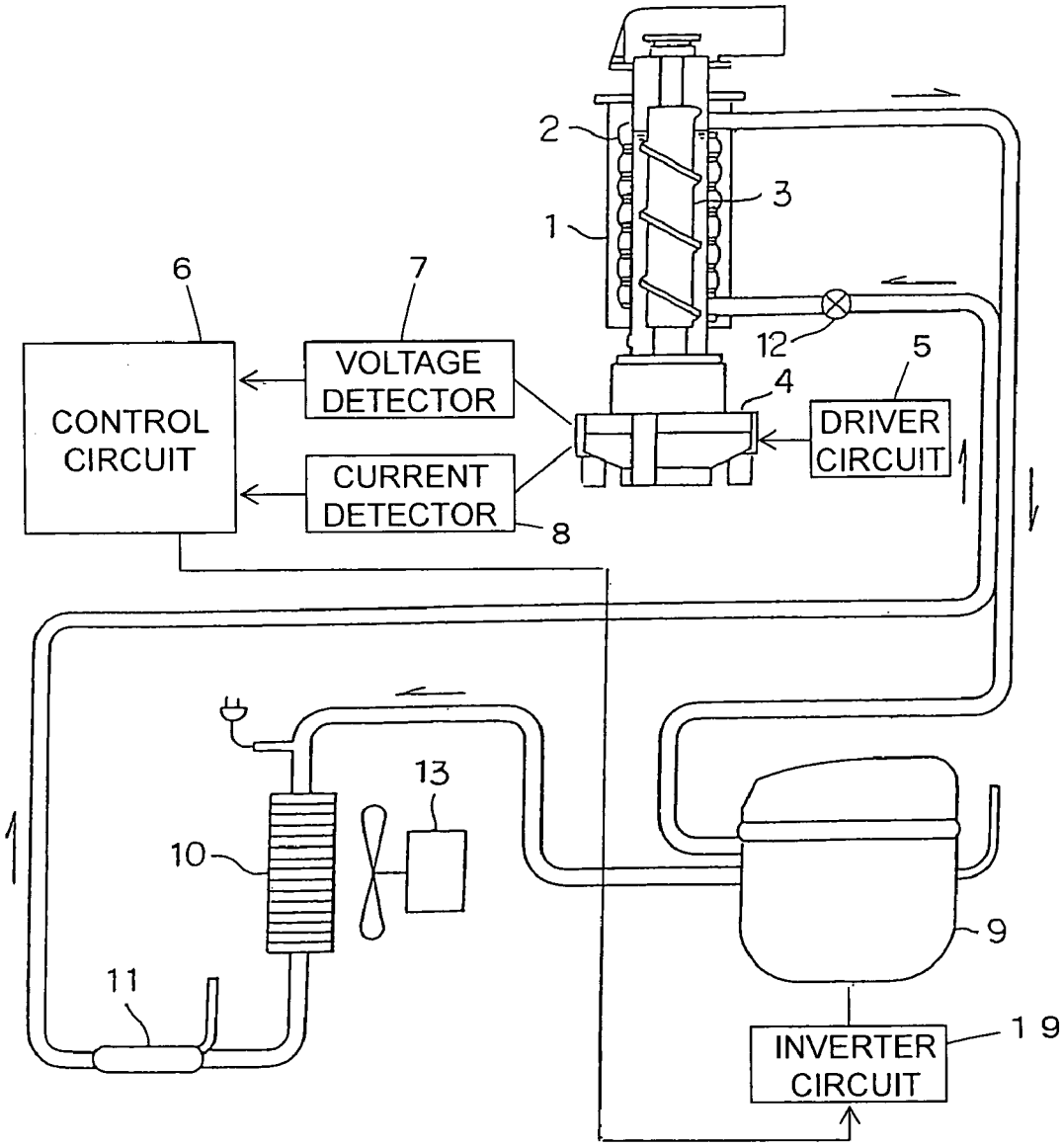
FIGS. 6 to 8 are block diagrams that show a configuration of an auger type ice making machine provided with a control device according to Embodiments 3 to 5, respectively.

FIG. 6 shows a configuration of an auger type ice making machine provided with a control device according to Embodiment 3. This auger type ice making machine is one in which the auger type ice making machine of Embodiment 2 shown in FIG. 4 has an inverter circuit 19 connected to the control circuit 6 and serving as a regulating circuit for driving the compressor 9 at variable speed as a substitute for the inverter circuit 18 that drives the fan motor 13. The control circuit 6 decreases the rotating speed of the compressor 9 for cases where it is judged that the refrigeration casing 1 has become overcooled, thus decreasing the refrigeration capacity so as to eliminate the overcooling.

Figure 5:
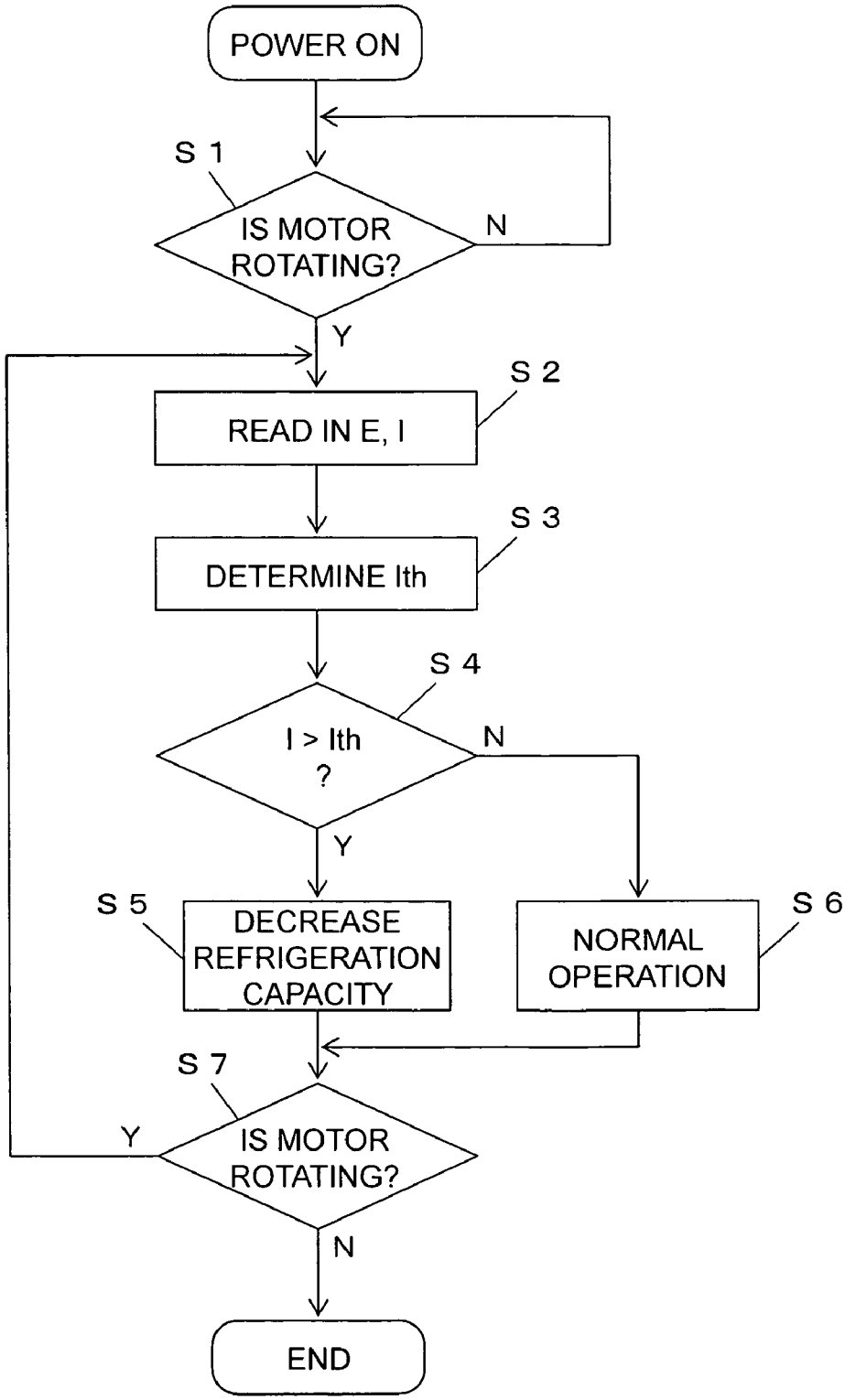
FIG. 5 is a flowchart that shows operation of Embodiment 2.

In other words, when the motor current I detected by the current detector 8 in step S4 is judged to exceed the threshold value Ith determined in step S3 in the flowchart of FIG. 5, the control circuit 6 controls the inverter circuit 19 in step S5 so as to decrease the rotating speed of the compressor 9. Not only does the amount of refrigerant circulating thus decrease, the refrigeration capacity of the refrigeration circuit also decreases, thus suppressing overcooling. The geared motor 4 continues to rotate at this point, and ice making operations continue.

Similar to Embodiment 2, when overcooling is eliminated and the motor current I becomes equal to or less than the threshold value Ith, the compressor 9 is returned to the rotating speed of normal operation in step S6.

Embodiment 4

Figure 7:
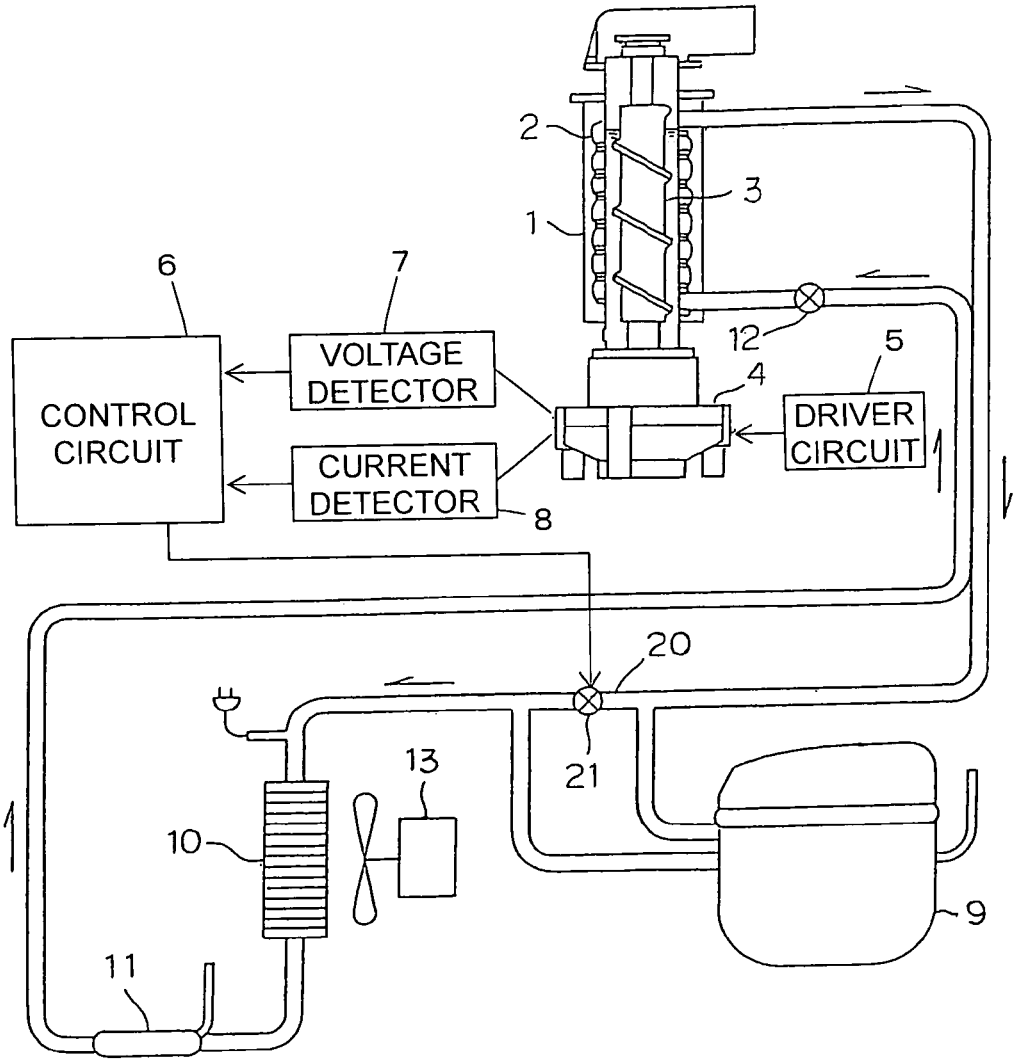

FIG. 7 shows a configuration of an auger type ice making machine provided with a control device according to Embodiment 4. This auger type ice making machine is one in which the auger type ice making machine of Embodiment 2 shown in FIG. 4 has a bypass pipe 20 that communicates with an outlet side of the compressor 9 of the refrigeration circuit and an outlet side of the evaporation pipe 2, and an electromagnetic valve 21 that opens and closes the pipeline provided along the bypass pipe 20. The control circuit 6 opens the electromagnetic valve 21 for cases where it is judged that the refrigeration casing 1 has become overcooled, bypassing around the compressor 9, and thus decreasing the refrigeration capacity so as to eliminate the overcooling.

In other words, when the motor current I detected by the current detector 8 in step S4 is judged to exceed the threshold value Ith determined in step S3 in the flowchart of FIG. 5, the control circuit 6 opens the electromagnetic valve 21 in step S5. Not only is the compressor 9 thus bypassed, the refrigeration capacity of the refrigeration circuit also decreases, thus suppressing overcooling. The geared motor 4 continues to rotate at this point, and ice making operations continue.

Similar to Embodiment 2, when overcooling is eliminated and the motor current I becomes equal to or less than the threshold value Ith, the electromagnetic valve 21 is closed in step S6, and operation returns to normal.

It should be noted that a bypass pipe that communicates with the outlet side of the compressor 9 and an inlet side of the evaporation pipe 2 may be provided as a substitute for the bypass pipe that communicates with the outlet side of the compressor 9 and the outlet side of the evaporation pipe 2, and the electromagnetic valve 21 may be attached to this bypass pipe.

Embodiment 5

Figure 8:
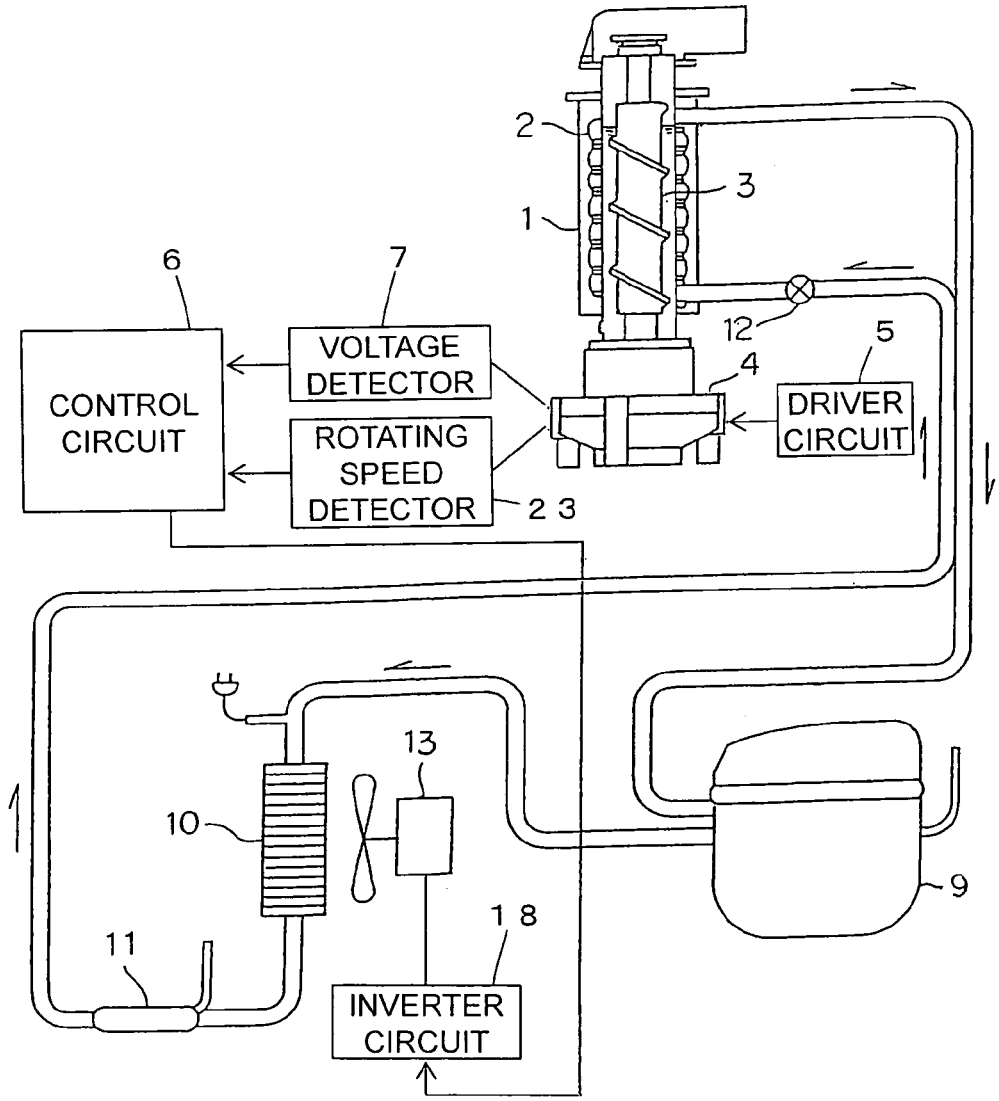

FIG. 8 shows a configuration of an auger type ice making machine provided with a control device according to Embodiment 5. This auger type ice making machine is one in which the auger type ice making machine of Embodiment 2 shown in FIG. 4 has a rotating speed detector 23 that detects the rotating speed of the geared motor 4 as a substitute for the current detector 8. The rotating speed detector 23 is connected to the control circuit 6.

Figure 9:
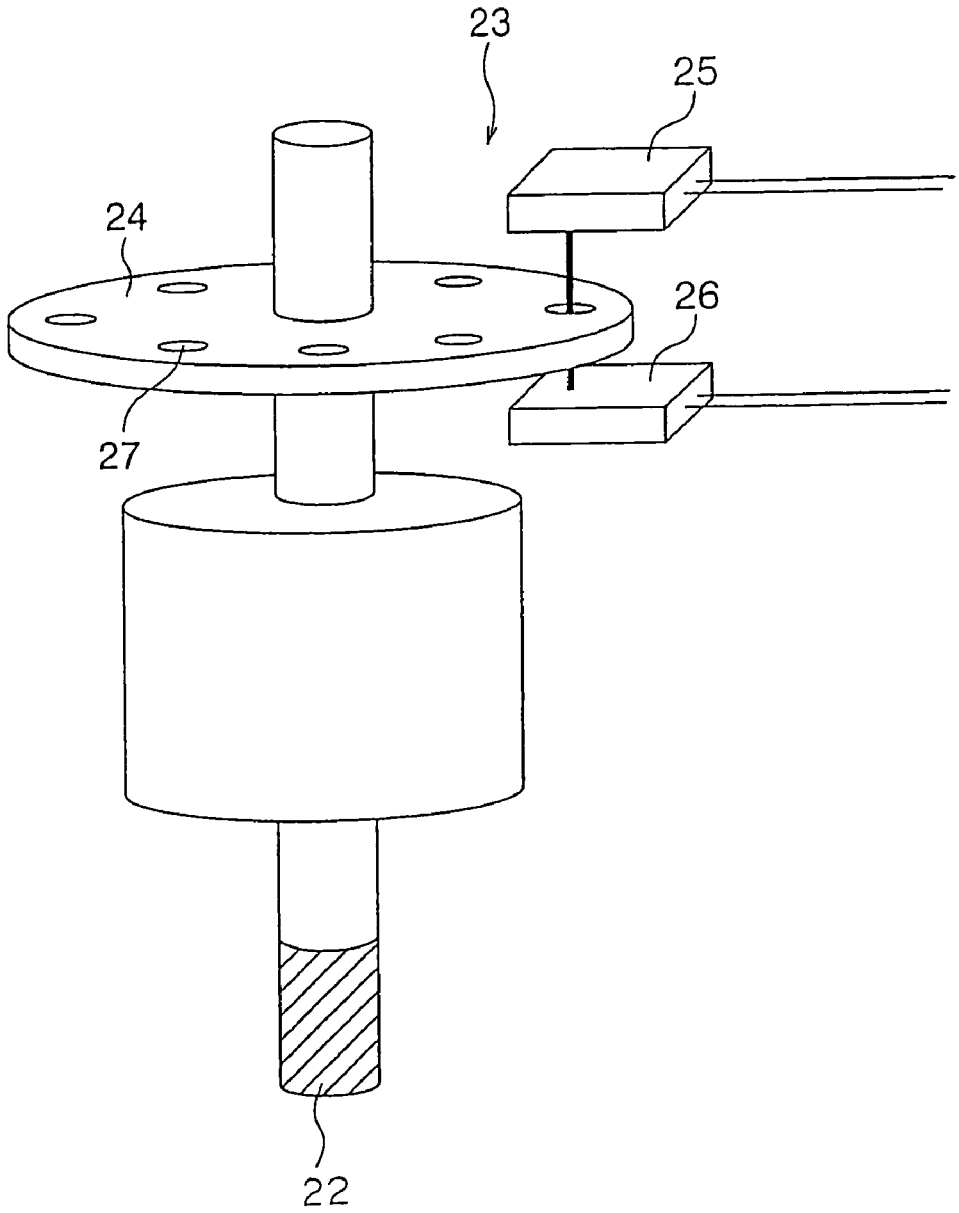
FIG. 9 is a perspective view that shows a configuration of a rotational speed detector used in Embodiment 5.

As shown in FIG. 9, a detector in which a rotary plate 24 is fixed to a rotor shaft 22 of the geared motor 4, and a plurality of through holes 27 or slits are formed along a circumferential edge portion of the rotary plate 24, for example, can be used as the rotating speed detector 23. A light emitting portion 25 and a light receiving portion 26 oppose each other so as to sandwich the circumferential edge portion of the rotary plate 24. When the rotary plate 24 rotates together with the rotor shaft 22, light emitted from the light emitting portion 25 arrives at the light receiving portion 26 only when passing through the through holes 27 of the rotary plate 24. Consequently, the revolution speed of the rotor shaft 22 can be detected by counting the number of times that the light is received by the light receiving portion 26. It should be noted that the configuration can be one in which a plurality of magnetic poles are disposed in the circumferential edge portion of the rotary plate 24 as a substitute for the through holes 27. A magnetic sensor detects the magnetic poles.

Operation of Embodiment 5 is explained with reference to a flowchart of FIG. 10. First, when electric power to the auger type ice making machine is turned on, water is supplied to the float tank (not shown), after which the refrigeration circuit is driven, the geared motor 4 is driven by the driving circuit 5, and ice making operations begin. When rotation of the geared motor 4 is verified by the control circuit 6 in step S11, in step S12, the control circuit 6 reads in a voltage value E of the input voltage of the geared motor 4 and a rotating speed N of the geared motor 4, detected by the voltage detector 7 and the rotating speed detector 23, respectively, and then determines a rotating speed threshold value Nth in the subsequent step S13, based on the voltage value E.

In addition, in step S14 the control circuit 6 compares the rotating speed N detected by the rotating speed detector 23 to the threshold value Nth determined in step S13. The control circuit 6 judges that the refrigeration casing 1 is overcooled when the rotating speed N is less than the threshold value Nth, and controls the inverter circuit 18 so as to decrease the rotating speed of the fan motor 13 in step S15. Not only does the condensation capacity of the condenser 10 thus decrease, the refrigeration capacity of the refrigeration circuit also decreases, thus suppressing overcooling. At this point the geared motor 4 continues to rotate, and ice making operations continue. On the other hand, when it is judged in step S14 that the rotating speed N is equal to or greater than the threshold value Nth, operation proceeds to step S16, and the inverter circuit 18 is controlled so that the fan motor 13 maintains the rotating speed of normal rotation.

Thereafter, when the geared motor is confirmed to be rotating in step S17, processing returns to step S12 and the voltage value E and the rotating speed N are read in again. The processing of steps S12 to S17 is then repeated.

Overcooling is therefore gradually eliminated while repeating the processes of steps S12 to S17 for cases where the rotating speed N is judged to be less than the threshold value Nth in step S14, and the rotating speed of the fan motor 13 is decreased in step S15. The fan motor 13 is returned to the rotating speed of normal operation in step S16 at the point where the rotating speed N becomes equal to or greater than the threshold value Nth.

Embodiment 6

Figure 11:
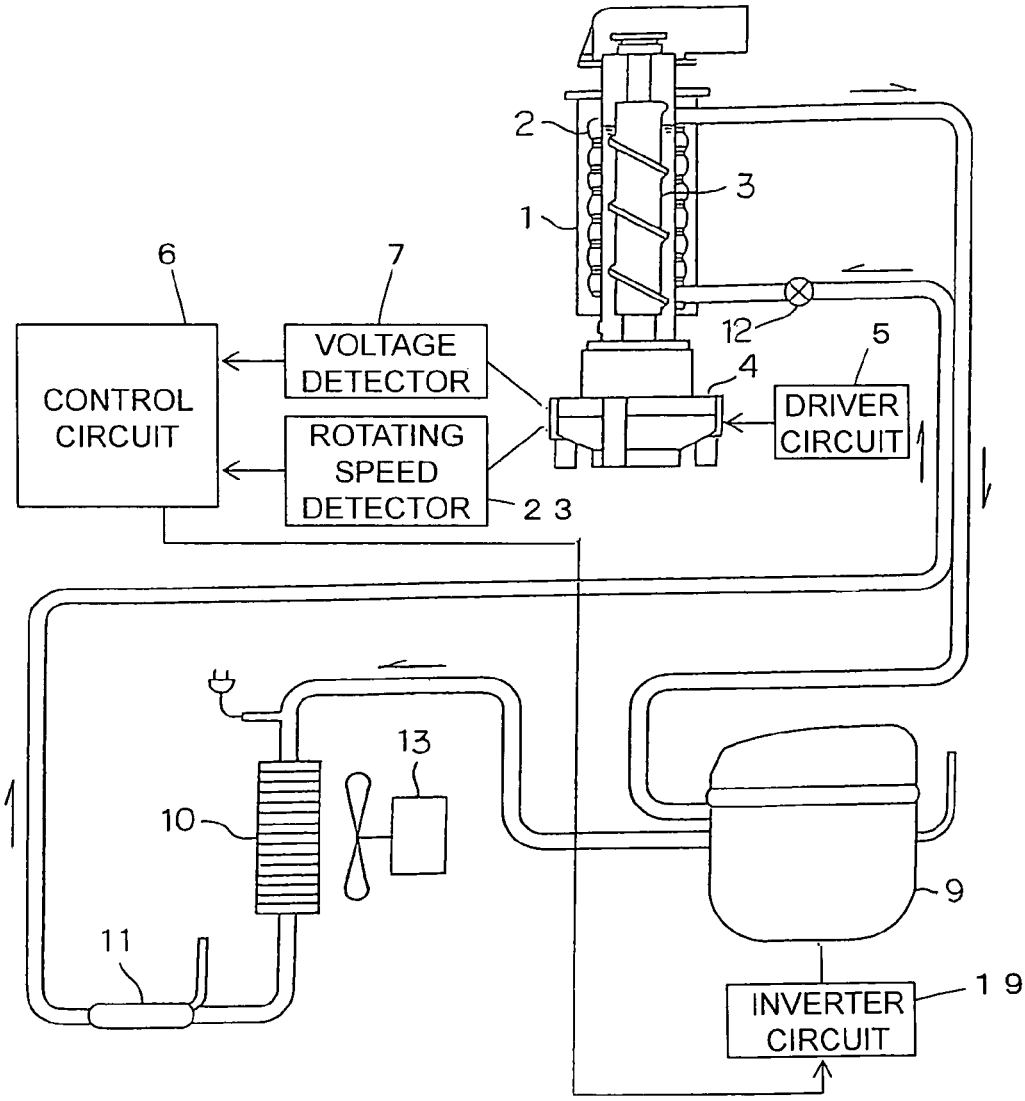
FIGS. 11 to 13 are block diagrams that show a configuration of an auger type ice making machine provided with a control device according to Embodiments 6 to 8, respectively.

FIG. 11 shows a configuration of an auger type ice making machine provided with a control device according to Embodiment 6. This auger type ice making machine is one in which the auger type ice making machine of Embodiment 5 shown in FIG. 8 has the inverter circuit 19 connected to the control circuit 6 for driving the compressor 9 at variable speed as a substitute for the inverter circuit 18 that drives the fan motor 13. The control circuit 6 decreases the rotating speed of the compressor 9 for cases where it is judged that the refrigeration casing 1 has become overcooled, thus decreasing the refrigeration capacity so as to eliminate the overcooling.

Figure 10:
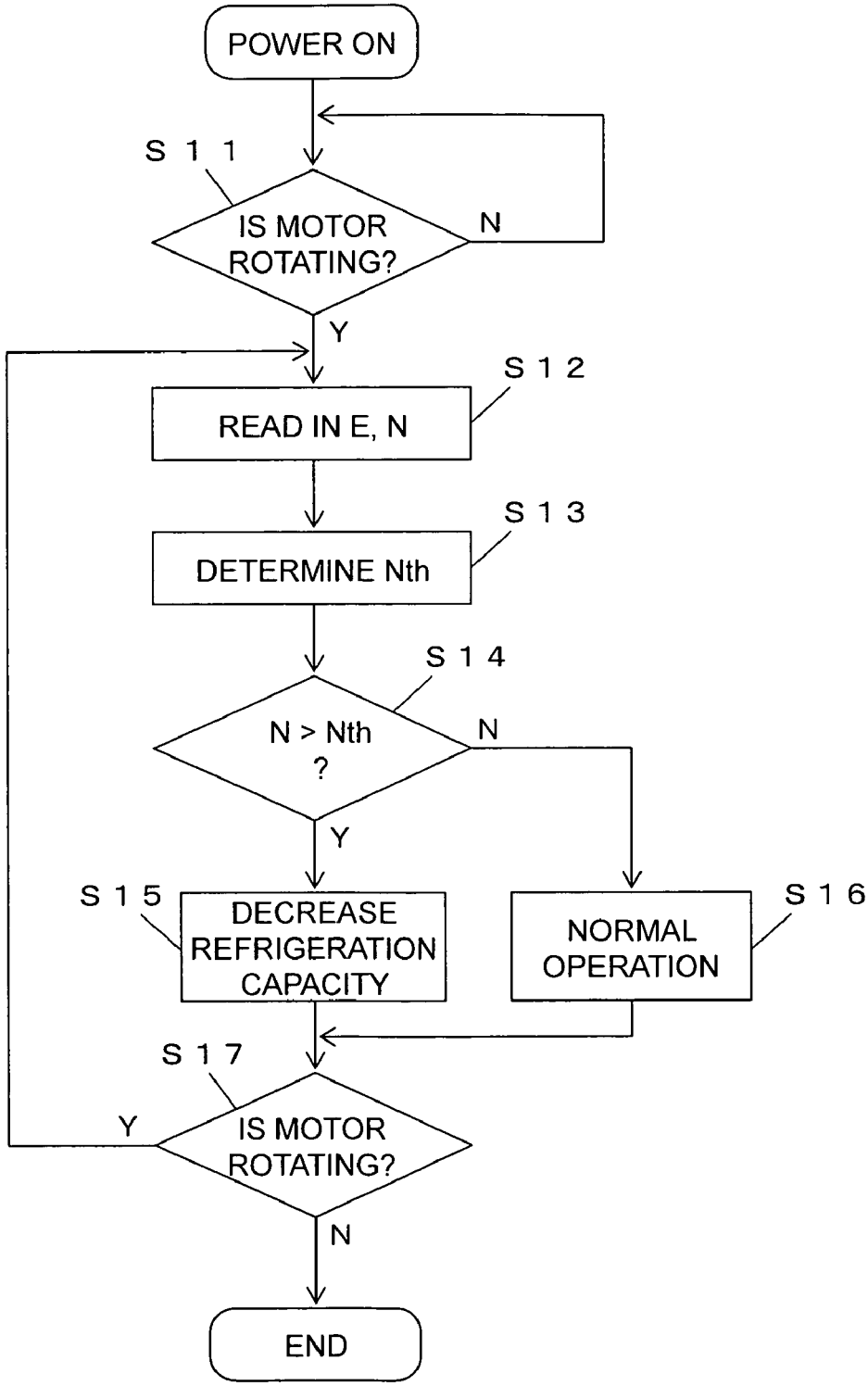
FIG. 10 is a flowchart that shows operation of Embodiment 5.

In other words, when the rotating speed N detected by the rotating speed detector 23 in step S14 is judged to be less than the threshold value Nth determined in step S13 in the flowchart of FIG. 10, the control circuit 6 controls the inverter circuit 19 in step S15 so as to decrease the rotating speed of the compressor 9. Not only does the amount of refrigerant circulating thus decrease, the refrigeration capacity of the refrigeration circuit also decreases, thus suppressing overcooling. The geared motor 4 continues to rotate at this point, and ice making operations continue.

Similar to Embodiment 5, when overcooling is eliminated and the rotating speed N becomes equal to or greater than the threshold value Nth, the compressor 9 is returned to the rotating speed of normal operation in step S16.

Embodiment 7

Figure 12:
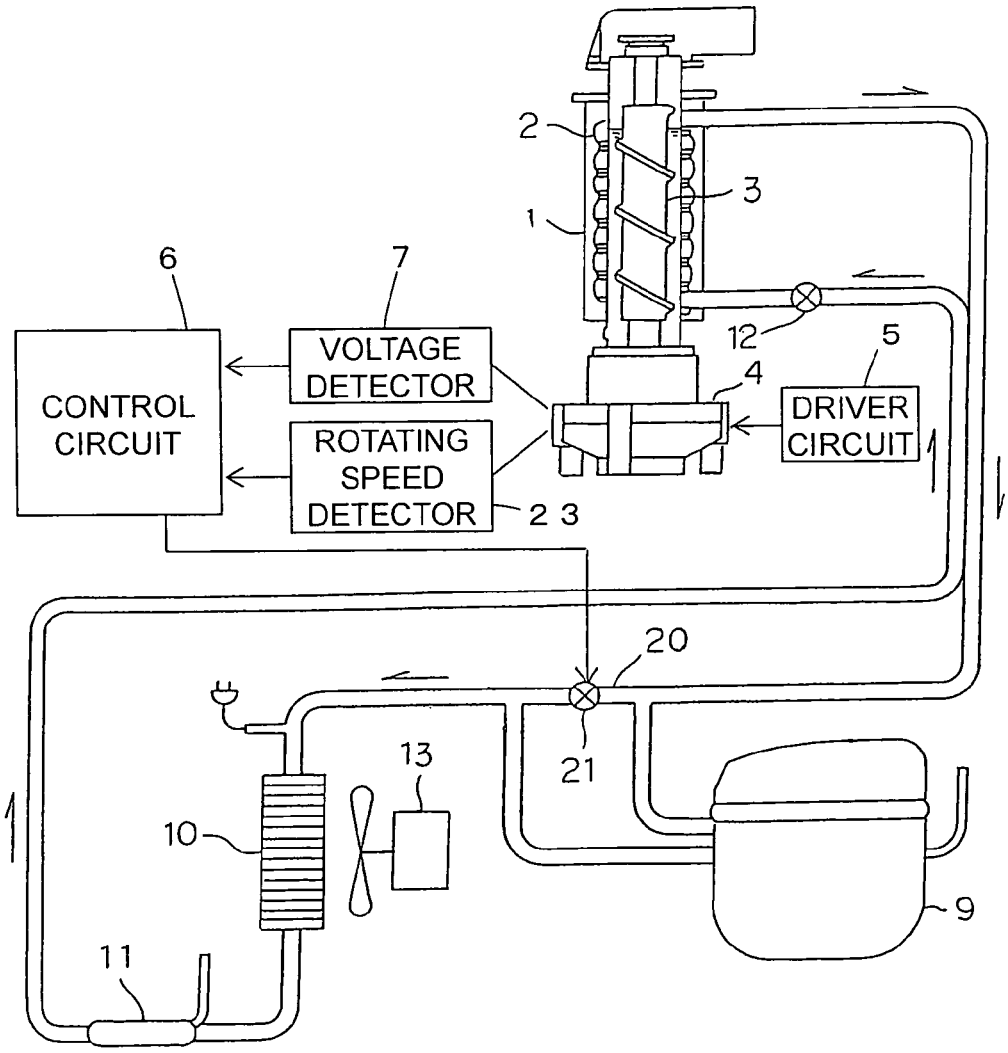

FIG. 12 shows a configuration of an auger type ice making machine provided with a control device according to Embodiment 7. This auger type ice making machine is one in which the auger type ice making machine of Embodiment 5 shown in FIG. 8 has the bypass pipe 20 that communicates with the outlet side of the compressor 9 of the refrigeration circuit and the outlet side of the evaporation pipe 2, and the electromagnetic valve 21 that opens and closes the pipeline provided along the bypass pipe 20. The control circuit 6 opens the electromagnetic valve 21 for cases where it is judged that the refrigeration casing 1 has become overcooled, bypassing around the compressor 9, and thus decreasing the refrigeration capacity so as to eliminate the overcooling.

In other words, when the rotating speed N detected by the rotating speed detector 23 in step S14 is judged to be less than the threshold value Nth determined in step S13 in the flowchart of FIG. 10, the control circuit 6 opens the electromagnetic valve 21 in step S15. Not only is the compressor 9 thus bypassed, the refrigeration capacity of the refrigeration circuit also decreases, thus suppressing overcooling. The geared motor 4 continues to rotate at this point, and ice making operations continue.

Similar to Embodiment 5, when overcooling is eliminated and the rotating speed N becomes equal to or greater than the threshold value Nth, the electromagnetic value 21 is closed in step S16, and operation returns to normal.

It should be noted that a bypass pipe that communicates with the outlet side of the compressor 9 and the inlet side of the evaporation pipe 2 may be provided as a substitute for the bypass pipe that communicates with the outlet side of the compressor 9 and the outlet side of the evaporation pipe 2, and the electromagnetic valve 21 may be attached to this bypass pipe.

Embodiment 8

Figure 13:
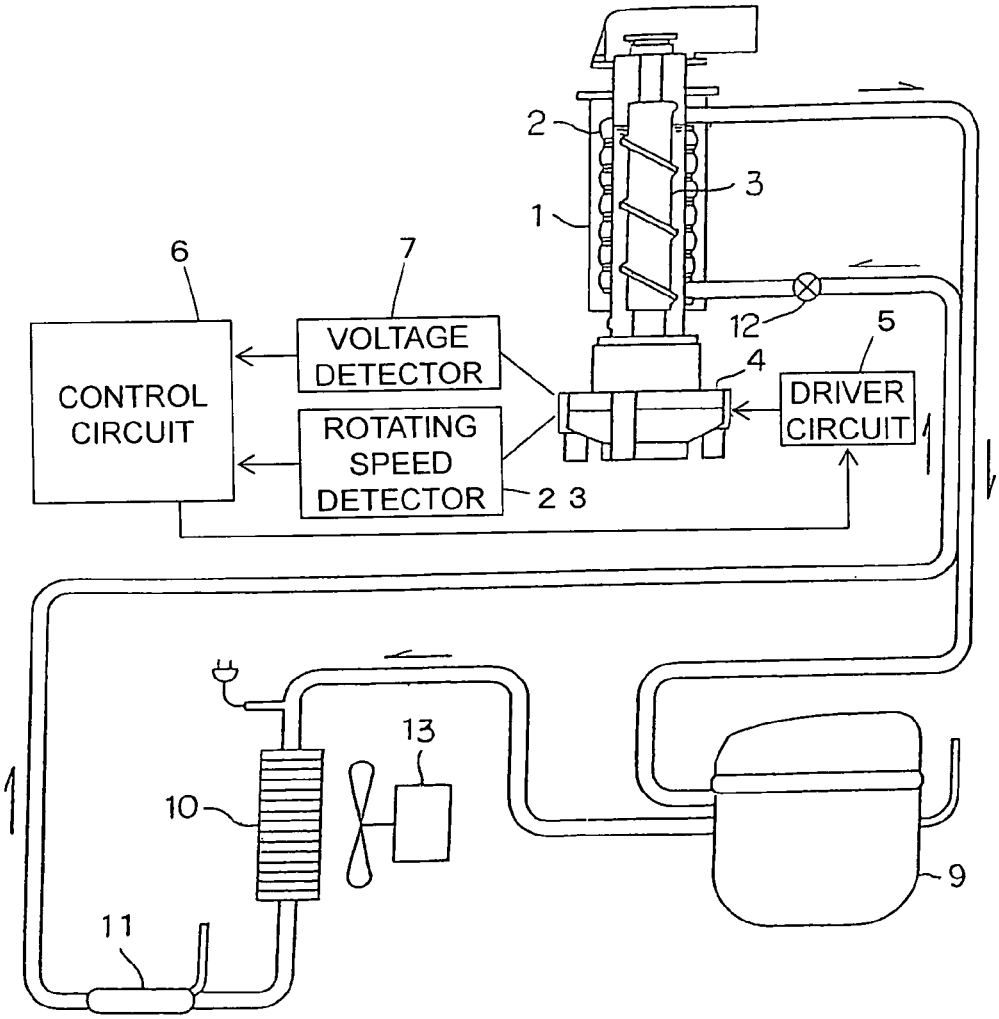
Figure 14A:
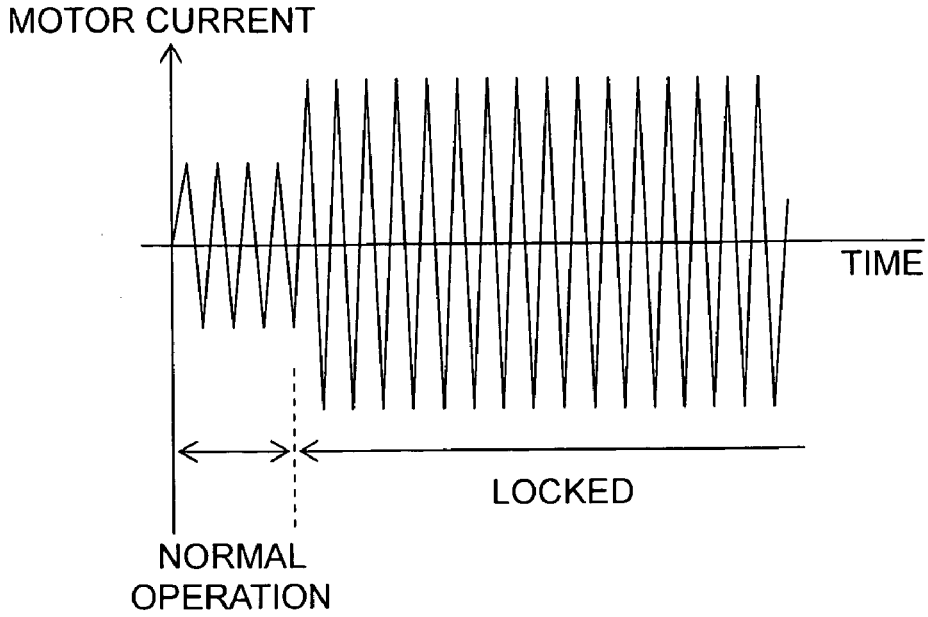
FIGS. 14*a* and 14*b* are timing charts that show motor current of a geared motor during low voltage input and during high voltage input, respectively.
Figure 14B:
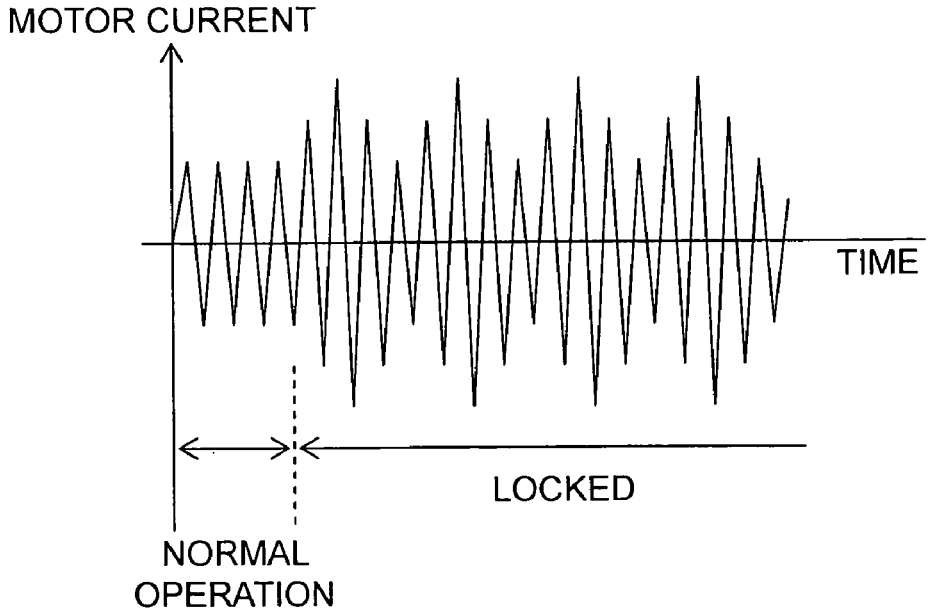

FIG. 13 shows a configuration of an auger type ice making machine provided with a control device according to Embodiment 8. This auger type ice making machine is one in which the auger type ice making machine of Embodiment 1 shown in FIG. 1 has the rotating speed detector 23 that detects the rotating speed of the geared motor 4 as a substitute for the current detector 8. The rotating speed detector 23 is connected to the control circuit 6.

A device shown in FIG. 9, for example, can be used as the rotating speed detector 23.

Operation of Embodiment 8 is explained next. First, when electric power to the auger type ice making machine is turned on, water is supplied to the float tank (not shown), after which the refrigeration circuit is driven, the geared motor 4 is driven by the driving circuit 5, and ice making operations begin.

The input voltage applied from the driver circuit 5 to the geared motor 4 is detected by the voltage detector 7 and the rotating speed N of the geared motor 4 is detected by the rotating speed detector 23 accompanying ice making operations. The detected values are sent to the control circuit 6. A plurality of the rotating speed threshold values Nth that differ according to the input voltage to the geared motor 4 are set in advance in the control circuit 6.

The control circuit 6 selects the rotating speed threshold value Nth that corresponds to the value of the input voltage detected by the voltage detector 7, and compares the rotating speed N detected by the rotating speed detector 23 with the selected threshold value Nth. When the value of the rotating speed N is less than the threshold value Nth, the control circuit 6 controls the driver circuit 5 to stop the geared motor 4.

The rotating speed N of the geared motor 4 decreases when, for some reason or another, the refrigeration casing 1 becomes overcooled because there is an ice blockage in an internal portion of the pressing head, there is an insufficient supply of ice making water, an abnormality occurs in the refrigeration circuit, or the like, and hunting begins to occur. Accordingly, the control circuit 6 controls the driver circuit 5 to stop operation of the geared motor 4 when the rotating speed N is less than the threshold value Nth.

One of the plural types of the rotating speed threshold values Nth set in advance is thus selected according to the input voltage to the geared motor 4, and a comparison with rotating speed N is performed. Accordingly, overload states such as hunting and locking can be accurately judged and operation of the geared motor can be stopped, even if the rotating speed N fluctuates according to input voltage values.

Furthermore, fluctuations in the rotating speed N on the same order as that during hunting occurs during start-up of the geared motor 4. Accordingly, it is preferable that the control circuit 6 be configured so as to ignore the rotating speed N value detected by the rotating speed detector 23 during start-up of the geared motor 4, and to cancel the first fluctuation in the rotating speed N occurring after the start-up.

Alternatively, it is preferable that the rotating speed threshold value Nth be set in advance in the control circuit 6 to a low value corresponding to start-up of the geared motor 4, and that the control circuit 6 be not actuated by the first current peak occurring after the start-up.

Erroneous operation during start-up can thus be prevented.

It should be noted that a regulating circuit that drives the fan motor 13 at variable speed by varying the input current to the fan motor 13 can also be provided as a substitute to the inverter circuit 18 in Embodiments 2 and 5. Similarly, a regulating circuit that drives the compressor 9 at variable speed by varying the input current to the compressor 9 can also be provided as a substitute to the inverter circuit 19 in Embodiments 3 and 6.

As explained above, with the auger type ice making machine control device according to the first aspect of this invention, an overloaded state can be accurately judged according to input voltage value, and a geared motor and the like can be protected, even if a motor current fluctuates according to input voltage value, because the plurality of current threshold values that differ according to input voltage are set in advance in the control circuit, and the geared motor is stopped when the value of the motor current detected by the current detector exceeds the current threshold value corresponding to the input voltage detected by the voltage detector.

Further, it is possible to prevent erroneous operation during start-up by making the control circuit ignore the value of the motor current detected by the current detector during start-up of the geared motor, or by making the control circuit have a high current threshold value corresponding to start-up of the geared motor.

With the auger type ice making machine control device according to the second aspect of this invention, the overloaded state can be accurately judged, and the geared motor and the like can be protected, even if the rotating speed fluctuates according to an input voltage value, because the plurality of rotating speed threshold values that differ according to input voltage are set in advance in the control circuit, and the geared motor is stopped when the value of the rotating speed detected by the rotating speed detector is less than the rotating speed threshold value corresponding to the input voltage detected by the voltage detector.

Further, it is possible to prevent erroneous operation during start-up by making the control circuit ignore the value of the rotating speed detected by the rotating speed detector during start-up of the geared motor, or by making the control circuit have a low rotating speed threshold value corresponding to start-up of the geared motor.

With the auger type ice making machine control device according to the third aspect of this invention, the overload state can be accurately judged by a suitable current threshold value, and a geared motor or the like can be protected, even if an input voltage to the geared motor changes, because the control circuit determines a motor current threshold value corresponding to the value of an input voltage detected by the voltage detector, and controls operation of a refrigeration circuit so as to decrease refrigeration capacity when a motor current value detected by the current detector exceeds the threshold value. Further, the overload is eliminated by decreasing the refrigeration capacity during the overload state without stopping the refrigeration circuit or the geared motor. Continuous ice making thus becomes possible, and the ice making efficiency increases.

Further, with the auger type ice making machine control device according to the fourth aspect of this invention, the overload state can be accurately judged by a suitable rotating speed threshold value, and the geared motor or the like can be protected, even if an input voltage to the geared motor changes, because the control circuit determines a rotating speed threshold value for the geared motor corresponding to the value of an input voltage detected by the voltage detector, and controls operation of the refrigeration circuit so as to decrease refrigeration capacity when a rotating speed value detected by the rotating speed detector is less than the threshold value. Further, the overload is eliminated by decreasing the refrigeration capacity during the overload state without stopping the refrigeration circuit or the geared motor. Continuous ice making thus becomes possible, and the ice making efficiency increases.

In general, a rotor shaft of the geared motor has a rotational velocity that is several hundreds of times greater than that of the auger. Consequently, the rotational resistance due to the auger can be detected with high precision provided that the value of the rotating speed detected by the rotating speed detector is used. Further, the rotating speed detector directly detects the rotating speed of the geared motor, and the reliability of load detection accordingly increases.

The invention claimed is:

1. A control device for an auger type ice making machine, comprising:

a driver circuit that drives a geared motor for rotating an auger;

a voltage detector that detects an input voltage applied to the geared motor;

a current detector that detects a motor current flowing in the geared motor; and a control circuit in which a plurality of current threshold values that differ according to the input voltage are set in advance, the control circuit controlling the driver circuit so as to stop the geared motor when a value of the motor current detected by the current detector exceeds a current threshold value that corresponds to the value of the input voltage detected by the voltage detector.

2. A control device for an auger type ice making machine according to claim 1, wherein the control circuit ignores a value of the motor current detected by the current detector during start-up of the geared motor.

3. A control device for an auger type ice making machine according to claim 1, wherein the plurality of current threshold values of the control circuit includes a high current threshold value corresponding to start-up of the geared motor.

4. A control device for an auger type ice making machine, comprising:

a driver circuit that drives a geared motor for rotating an auger;

a voltage detector that detects an input voltage applied to the geared motor;

a rotating speed detector that detects a rotating speed of the geared motor; and a control circuit in which a plurality of rotating speed threshold values that differ according to the input voltage are set in advance, the control circuit controlling the driver circuit so as to stop the geared motor when a value of the rotating speed detected by the rotating speed detector is less than a rotating speed threshold value that corresponds to the value of the input voltage detected by the voltage detector.

5. A control device for an auger type ice making machine according to claim 4, wherein the control circuit ignores a value of the rotating speed detected by the current detector during start-up of the geared motor.

6. A control device for an auger type ice making machine according to claim 4, wherein the plurality of rotating speed threshold values in the control circuit includes a high rotating speed threshold value corresponding to start-up of the geared motor.

7. A control device for an auger type ice making machine, comprising:

a voltage detector that detects an input voltage applied to a geared motor for rotating an auger;

a current detector that detects a motor current flowing in the geared motor; and a control circuit which determines a threshold value for the motor current according to a value of the input voltage detected by the voltage detector, wherein the control circuit controls operation of a refrigeration circuit of the ice making machine such that a refrigeration capacity of the refrigeration circuit decreases when a value of the motor current detected by the current detector exceeds the threshold value.

8. A control device for an auger type ice making machine according to claim 7, further comprising:

a fan motor for cooling a condenser of the refrigeration circuit; and a regulating circuit that drives the fan motor at variable speed, wherein the control circuit decreases the refrigeration capacity of the refrigeration circuit by controlling the regulating circuit so as to decrease a rotating speed of the fan motor.

9. A control device for an auger type ice making machine according to claim 7, further comprising a regulating circuit that drives a compressor of the refrigeration circuit at variable speed, wherein the control circuit decreases the refrigeration capacity of the refrigeration circuit by controlling the regulating circuit so as to decrease a rotating speed of the compressor.

10. A control device for an auger type ice making machine according to claim 7, further comprising:

a bypass pipe that communicates an outlet side of a compressor of the refrigeration circuit with an outlet side or an inlet side of an evaporation pipe; and an electromagnetic valve attached to the bypass pipe, wherein the control circuit decreases the refrigeration capacity of the refrigeration circuit by opening the electromagnetic valve to guide coolant to the bypass pipe.

11. The control device of claim 7, wherein the control circuit decreases the refrigeration capacity of the refrigeration circuit without ceasing ice making operations of the ice making machine.

12. A control device for an auger type ice making machine, comprising:

a voltage detector that detects an input voltage applied to a geared motor for rotating an auger;

a rotating speed detector that detects a rotating speed of the geared motor; and a control circuit which determines a threshold value for the rotating speed of the geared motor according to a value of the input voltage detected by the voltage detector, wherein the control circuit controls operation of a refrigeration circuit of the ice making machine such that a refrigeration capacity of the refrigeration circuit decreases when a value of the rotating speed detected by the rotating speed detector is less than the threshold value.

13. A control device for an auger type ice making machine according to claim 12, further comprising:

a fan motor for cooling a condenser of the refrigeration circuit; and a regulating circuit that drives the fan motor at variable speed, wherein the control circuit decreases the refrigeration capacity of the refrigeration circuit by controlling the regulating circuit so as to decrease a rotating speed of the fan motor.

14. A control device for an auger type ice making machine according to claim 12, further comprising a regulating circuit that drives a compressor of the refrigeration circuit at variable speed, wherein the control circuit decreases the refrigeration capacity of the refrigeration circuit by controlling the regulating circuit so as to decrease the rotating speed of the compressor.

15. A control device for an auger type ice making machine according to claim 12, further comprising:

a bypass pipe that communicates an outlet side of a compressor of refrigeration circuit with an outlet side or an inlet side of an evaporation pipe; and an electromagnetic valve attached to the bypass pipe, wherein the control circuit decreases the refrigeration capacity of the refrigeration circuit by opening the electromagnetic valve to guide coolant to the bypass pipe.

16. The control device of claim 12, wherein the control circuit decreases the refrigeration capacity of the refrigeration circuit without ceasing ice making operations of the ice making machine.

17. An auger type ice making machine comprising:

a refrigeration casing;

a refrigeration circuit including a compressor, a condenser, a drier, an expansion valve, and an evaporation pipe for cooling ice making water so as to form ice in the refrigeration casing;

an auger having a helical blade for scraping ice off an inner circumferential surface of the refrigeration casing;

a geared motor for rotating the auger; and the control device of claim 1 for controlling the geared motor.

18. An auger type ice making machine comprising:

a refrigeration casing;

a refrigeration circuit including a compressor, a condenser, a drier, an expansion valve, and an evaporation pipe for cooling ice making water so as to form ice in the refrigeration casing;

an auger having a helical blade for scraping ice off an inner circumferential surface of the refrigeration casing;

a geared motor for rotating the auger; and the control device of claim 4 for controlling the geared motor.

19. An auger type ice making machine comprising:

a refrigeration casing;

a refrigeration circuit including a compressor, a condenser, a drier, an expansion valve, and an evaporation pipe for cooling ice making water so as to form ice in the refrigeration casing;

an auger having a helical blade for scraping ice off an inner circumferential surface of the refrigeration casing;

a geared motor for rotating the auger; and the control device of claim 7 for controlling the refrigeration circuit.

20. An auger type ice making machine comprising:

a refrigeration casing;

a refrigeration circuit including a compressor, a condenser, a drier, an expansion valve, and an evaporation pipe for cooling ice making water so as to form ice in the refrigeration casing;

an auger having a helical blade for scraping ice off an inner circumferential surface of the refrigeration casing;

a geared motor for rotating the auger; and the control device of claim 11 for controlling the refrigeration circuit.

* * * * *